US006431540B1

(12) United States Patent
Lien et al.

(10) Patent No.: US 6,431,540 B1
(45) Date of Patent: Aug. 13, 2002

(54) CARD FEED ROLLER FOR PRINTER

(75) Inventors: Brent D. Lien, Minneapolis; Thomas J. Reynolds-Kotz, Burnsville, both of MN (US)

(73) Assignee: Fargo Electronics, Inc., Eden Prairie, MN (US)

( * ) Notice: Subject to any disclaimer, the term of this patent is extended or adjusted under 35 U.S.C. 154(b) by 0 days.

(21) Appl. No.: 09/627,524

(22) Filed: Jul. 28, 2000

(51) Int. Cl.[7] ..... B65H 3/06
(52) U.S. Cl. ..... 271/109; 271/119
(58) Field of Search ..... 271/109, 119; 492/28, 37, 39, 59

(56) References Cited

U.S. PATENT DOCUMENTS 4,664,252 A * 5/1987 Galbraith
5,993,952 A * 11/1999 Cox et al. ..... 271/109 X
6,139,006 A * 10/2000 Asada ..... 271/109 X

* cited by examiner

*Primary Examiner*—David H. Bollinger
(74) *Attorney, Agent, or Firm*—Westman, Champlin & Kelly, P.A.

(57) ABSTRACT

A card feed drive roller is provided with a drive section that is a soft elastomeric-material which has a coefficient of friction adequate to break away lower cards in a substantial stack of cards and has at least one support section that is of harder material that will limit the amount of compression of the drive section under weight of the card stack. The limitation of the compression of the drive section insures that when an outlet opening is adjusted it will be high enough so one card will always fit through the outlet opening, and multiple cards will not be fed through the opening.

17 Claims, 2 Drawing Sheets

CARD FEED ROLLER FOR PRINTER

BACKGROUND OF THE INVENTION

The present invention relates to a drive roller for feeding an individual substrate, such as an identification card, from a stack of such substrates. The feed roller includes a soft section that supports one surface of a lower substrate in the stack and that provides a high friction surface for positive feeding force, and another harder section that limits compression of the soft section of the roller to control the position of the substrate to effectively limit the size of the outlet from the hopper.

Most printers that print on identification cards feed a bottom card from a stack of cards held in a hopper to the printer. While various developments have been made for restricting the outlet opening from card hoppers, including experimenting with different hardnesses for the feed rollers, problems still persist.

The feed rollers support the card stack so the top edge of the bottom card is below an upper edge of the outlet opening from the hopper. The outlet opening typically will be set to a height of 1½ times the card thickness. For individual cards or stacks with few cards, the setting works. However, as the weight of the stack increases for a full stack of cards, the feed roller compresses, and the bottom card moves down, away from the upper edge of the outlet opening, thereby effectively increasing the vertical size of the outlet opening and resulting in double feed.

A feed roller has to provide a high enough friction force to pull a card from the bottom of a stack, and the high friction roller materials are soft, so the compression of the roller from the weight of the stack is enough so that two cards may be driven under the outlet opening upper edge and through the outlet opening.

If the opening. is set so the height of the opening is 1½ times the card thickness with a full stack of cards, as the stack becomes lighter, the feed roller will be compressed less and the vertical height of the opening will become less than the card thickness to thereby block cards from moving through-the opening.

In the prior art, various neoprene rollers have also been utilized. These harder rollers will not compress so as to allow multiple cards to fit through a controlled opening, but they do not provide enough surface friction to drive cards when the stack is high, for example when in the range of 250 cards. The-cards tend to adhere to each other and the friction between the bottom and next adjacent card may exceed the feed roller drive force.

Isoprene rollers of relative low durometer also have been used, but in conventional arrangements isoprene will compress too much when the weight of the stack is great. The compression may be enough so the outlet of the hopper enlarges enough so more than one card will be fed, or, as explained, if the opening is set with a full stack of cards in place, the opening may close up as the stack reduces in weight.

Card support platforms at the bottom of the stack can be provided with a top portion of a feed roller extending through a slot in the platform to engage a card. The cards have to slide on the platform as they are fed and will tend to be scratched. The platform also has to be very precisely adjusted relative to the target or support plane of the feed roller, which is difficult.

SUMMARY OF THE INVENTION

The present invention relates to a drive or feed roller for reliably feeding substrates, such as identification cards, from a hopper containing a stack of such. substrates to a printer. The drive roller has a card driving portion that is relatively low durometer, with a high coefficient friction on its exterior surface and a stiffer or harder smaller diameter section that forms a substrate support to restrict compression of the low durometer section. The high friction section extends for a length along the roller drive axis that is adequate to provide a total force from friction to drive a card that it engages to reliably feed the bottom card. The smaller diameter section comprises at least one disc of slightly smaller diameter than the high friction drive section that will permit the drive section to compress under loads, but only to the size (radius) of the disc. The harder disc or disc section limits the compression of the low durometer drive section, so that the drive section will not compress under the weight of the card stack to an extent that the lower card moves away from the outlet opening upper edge sufficient to permit more than one card to feed through the hopper outlet opening. Alternatively, if the outlet opening is adjusted with a full stack in place, the stack is supported on the hard discs and subsequent expansion of the feed or drive roller as the stack becomes lighter will not be sufficient to reduce the height of the outlet opening to less than the card thickness.

Preferably, the drive roller has the drive section of the soft, high friction material, such as isoprene, in the center, and has two discs, one at each of the opposite ends of the drive section. Both the drive section and the discs are drivably mounted onto a drive shaft. A motor is used for rotating the roller.

Limiting the compression of the softer high friction drive section thus provides for adequate control of hopper outlet size, while the lower durometer elastomeric center section provides adequate friction drive for cards, even when the cards are in a large stack.

Additionally, the drive section of the roller can have a crepe finish (irregular) that increases the overall coefficient of friction of the drive section.

The supporting discs on the roller, which are of slightly smaller diameter than the drive section, can be made of any material that is harder than the drive section and which will not substantially compress. A hard, low friction plastic material such as an acetal resin sold under the trademark/trade name Delrin by E. I. DuPont de Nemours and Company has been found satisfactory for the discs.

DETAILED DESCRIPTION OF THE ILLUSTRATIVE EMBODIMENTS

Figure 1:
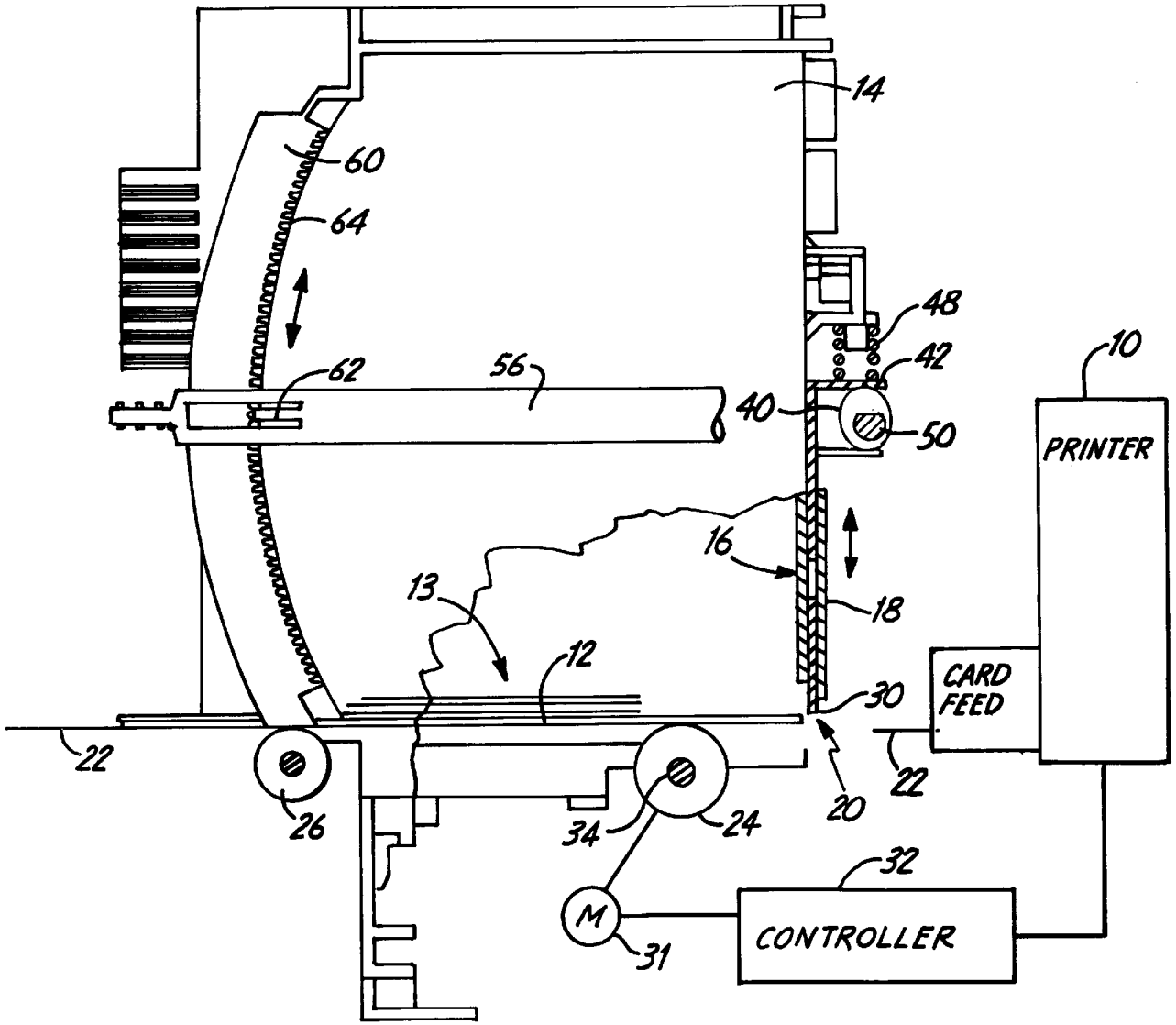
FIG. 1 is a schematic side elevation view of a printer having a card feed hopper mounted thereto, and showing a drive roller made according to the present invention installed thereon.

Referring to FIG. 1 a printer assembly indicated generally at 10 is shown as a block. Printer 10 is a card printer of conventional design that is used for printing identification cards, such as those shown at 12, stacked in a hopper 14 that provides a supply of the cards to the printer. The hopper 14 includes a front wall 16 preferably with an adjustable outlet gate 18 that controls the position of a flexible strip having a lower edge 30 that defines the top or upper edge of a hopper outlet opening 20. The. bottom of the outlet opening 20 is defined by a card support plane 22 that is defined by the top of a drive or feed roller 24 and an idler support roller 26. The drive roller 24 and support roller 26 support the stack 13 of the cards 12. The bottom surface of the lowermost card 12 in the stack directly engages the drive roller 24 and when the roller 24 is rotated it will drive the bottom card 12 toward the printer.

The vertical height of the outlet opening 20 can be adjusted by lifting the gate 18 and raising or lowering edge 3 using a cam 40 acting on a lip. 42 of gate 18, as adjusted by pivoting a cam shaft 50 with a lever 56. A spring 48 acts to load the lip 42 against the cam 40. A ratchet latch 64 is engaged by a spring tongue 62 on the lever 56 to hold the lever in place.

The controlled outlet opening 20 can be adjusted with the gate 18 to a desired vertical dimension size depending on the thickness of the cards 12, to insure that with the plane 22 at a normal position, that is, without the roller 24 compressed, only one card 12 at a time will be permitted out through the outlet opening 20. The lower edge 30 of the flexible strip is spaced the desired, set amount above the reference plane 22, and only cards of a desired size will be fed, unless the plane 22 moves downwardly, which can occur if the drive roller 24 compresses too much.

The drive or feed roller 24 is driven through the use of a motor 31 that can be any conventional design, but generally is a stepper motor controlled from a central controller 32. The controller 32 also controls the printer 10, so that sequential feeding and operation, and then printing, can take place.

When a stack 13 of cards 12 in the hopper 14 is quite high, for example in the range of 250–350 cards, the weight on the drive roller 24 and the idler roller 26 can be quite high, for example in the range of 3–4 lbs. or so. The cards 12 generally are relatively rigid, particularly when-the cards are in the standard range of 10 mils to 30 mils thick. The cards 12 will tend to stick together (stiction friction) so that feeding the bottom card 12 requires a substantial amount of frictional drive force on the undersurface of the bottom card.

The drive roller 24 of the present invention is made with a section of a soft enough elastomer to provide a drive friction force that is adequate for driving the bottom card, even in a large stack. The drive roller also is made so that it will not compress excessively and so that the plane 22 does not shift downwardly enough relative to edge 30 to enlarge the vertical height of the outlet opening 22 so that two cards will be fed at a time.

Figure 2:
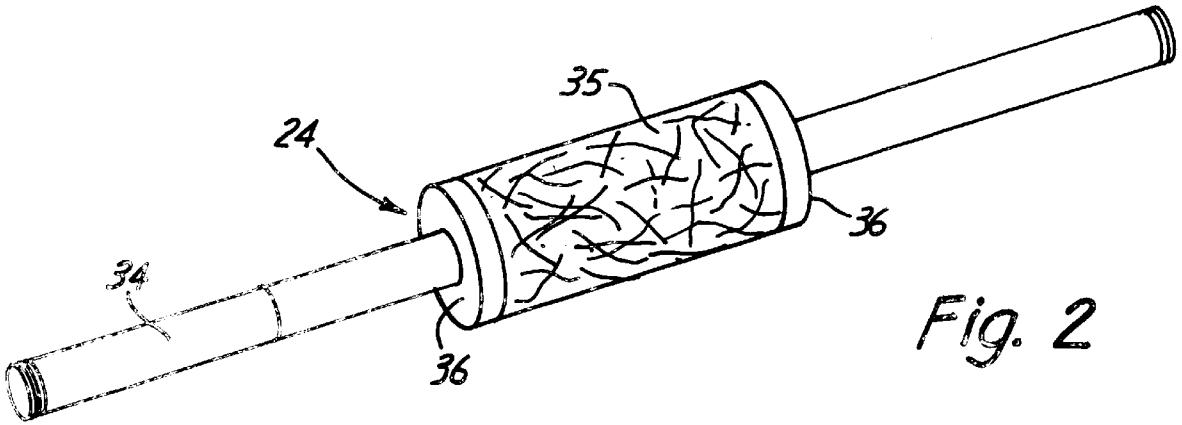
FIG. 2 is a perspective view of a drive roller made according to the present invention.
Figure 3:
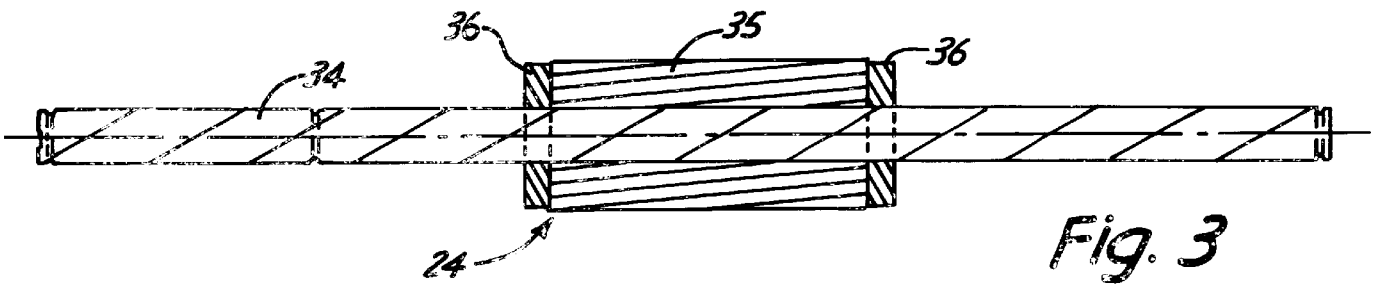
FIG. 3 is a vertical sectional view of the drive roller and drive shaft as shown in FIG. 2.

Referring to FIGS. 2 and 3, the drive roller 24, as shown, is mounted onto a central shaft 34, and includes a cylindrical center drive section 35 of a suitable soft elastomeric material, such as isoprene in the range of 40 durometer. Additionally, the drive section 35 preferably has a crepe exterior finish, which is a non smooth finish with small indents or pockets, in order to increase the overall coefficient of friction of this drive section 35. In the forms shown, the drive section 35 is positioned between support discs 36, which are drivably mounted on the shaft 34 at opposite ends of the drive section 35. The support discs 36 are made with a cylindrical outer surface with nominal outer diameter that is slightly less than a nominal outer diameter of the drive section 35.

For example, with a drive roller center drive section 35 that is in the range of just under threequarters of an inch in diameter, the diameter of the support discs 36 will be in the range of 0.008 to 0.010 smaller diameter to permit the center section 35 to compress slightly under the weight of the card stack, and thereby provide a friction drive force on the bottom card when the drive shaft 34 is driven with the motor 30. The softer center drive section 35 insures an adequate feeding force for the bottom card, but the harder discs 36 limit the compression of the. center section 35. The discs 36 support the card stack 13 without compressing substantially and will not permit compression of the roller to a diameter where the outlet opening 20 is increased in vertical height so as to permit more than one card to feed through the opening. The discs 36 will support the undersurface of a card without further reducing the diameter of the center drive section 35 of the roller and thus restricting the amount the bottom card can move down, away from the top edge of the outlet opening.

The soft isoprene or other elastomer material of the center drive section 35 will provide the needed drive force, while the discs 36 at opposite ends, as shown, will support the card 12 in a manner that will prevent over compression of the soft roller section 35 even when a large number of cards are in the supported stack.

It should be noted that the compression limiting components do not necessarily have to be discs at the ends of a soft drive section, but for example there could be one disc in the center of two soft drive sections of the roller, with or without discs at the outer ends, or two discs which are sandwiched between three drive sections on the roller. However for manufacturing purposes and for adequate support at the proper locations on the card, the discs at the ends of one high friction drive section are preferred. Also, a roller that had integrally molded sections of different hardness can be used. A soft outer layer and a harder inner layer next to the shaft will limit compression as well.

Again, an overall difference in diameter of the discs from the diameter of the center section in the range of between 0.005 inches and 0.0010 inches is a desirable range, with the preferred diametrical compression not greater than 0.008 inches. The amount of compression of the roller has to be limited to insure that the support plane 22 does not move away from the upper edge 30 of the opening 20, so that the second card from the bottom of the stack of cards is permitted to move out.

The length of the drive section 35 and the discs 36 are such that the overall length of the roller 24 is less than that than the width of the card 12 that is being fed. In other words, the discs 35 are within the side edges of a card 12 in order to provide the support that is necessary. The discs 35 can be selected in axial length to provide adequate support for a normal range of cards of different widths that are presently being made.

It also can be noted that the roller could be molded of two different durometer materials with the ends machined to have shoulders formed where the discs that are illustrated are positioned. When the shoulder or the outer surface of the disc is slightly lower, for example, 0.008 inches smaller diameter, the maximum compression of the roller is 0.004 inches on the radius at any one point, ignoring any slight compression of the discs. The drive roller 24 that has two different hardnesses permits the use of a low durometer material with a high coefficient of friction for driving the card while the second section or portion of the roller forming the shoulder is a support to prevent over compression of the drive section. If the roller is permitted to compress too much it will open the outlet from a hopper sufficiently to permit more than one card to be fed.

Although the present invention has been described with reference to preferred embodiments, workers skilled in the art will recognize that changes may be made in form and detail without departing from the spirit and scope of the invention.

What is claimed is:

1. A feeder for a stack of cards supported in a hopper, with a bottom card supported in part on a drive roller, the improvement comprising the drive roller having at least two sections of different hardnesses along an axis, including a drive section of low durometer elastomeric material, and at least one support section that is harder than the drive section and resists compression from weight of a card stack on the roller.

2. The improvement of claim 1, wherein the support section comprises a pair of discs and the drive section is centered between the pair of support discs.

3. The improvement of claim 1, wherein said drive section is made of an elastomeric material in the range of 40 durometer.

4. The improvement of claim 1, wherein said drive section has a crepe surface finish.

5. The improvement of claim 4, wherein the drive section is made of isoprene.

6. The improvement of claim 1, wherein said drive section is preferably in the range of between 0.005, and 0.0010 inches greater than the diameter of the support disc.

7. The improvement of claim 1, wherein said support sections comprise discs that are supported at ends of the drive section, and are made of a hard low friction plastic.

8. The improvement of claim 7, wherein said discs are in the range of 0.008 inches smaller in diameter than the drive section.

9. The improvement of claim 1, wherein said drive section is a elastomer in they range of 40 durometer, and is provided with a crepe finish.

10. The improvement of claim 1, wherein said drive section is made of isoprene, and wherein the support section comprises a pair of discs-positioned at opposite ends of the drive section.

11. The improvement of claim 10, wherein the discs are made of material having the hardness of an acetal resin.

12. A drive roller for a suitable feeder comprising a drive shaft, a first roller drive section of high coefficient friction material, and at least one support section that is made of a harder material than the drive section and which resists compression from weight supported on the drive roller.

13. The roller of claim 12, wherein the support section comprises a pair of discs and the drive section is centered between the pair of support discs.

14. The roller of claim 13, wherein said support sections comprise discs that are supported at ends of the drive section, and are made an acetal resin.

15. The roller of claim 14, wherein said discs are in the range of 0.008 inches smaller in diameter than the drive section.

16. The roller of claim 15, wherein the drive section is made of isoprene.

17. The roller of claim 12, wherein said drive section is made of an elastomeric material having a hardness in the range of 40 durometer.

* * * * *

UNITED STATES PATENT AND TRADEMARK OFFICE

CERTIFICATE OF CORRECTION

PATENT NO. : 6,431,540 B1 
DATED : August 13, 2002
INVENTOR(S) : Brent D. Lien and Thomas J. Reynolds-Kotz It is certified that error appears in the above-identified patent and that said Letters Patent is hereby corrected as shown below:

Column 6,
Line 2, "they" should be -- the --
Line 6, delete "-"
Line 21, after "made" insert -- of --

Signed and Sealed this

Twenty-seventh Day of April, 2004

JON W. DUDAS
*Acting Director of the United States Patent and Trademark Office*